US006694546B1

(12) United States Patent
Kasem

(10) Patent No.: US 6,694,546 B1
(45) Date of Patent: Feb. 24, 2004

(54) CANOPY ASSEMBLY HAVING UNIVERSAL COMPONENTS FOR DIFFERENT TYPES OF CANOPIES

(76) Inventor: Jean Kasem, 138 Mapleton, Los Angeles, CA (US) 90077

( * ) Notice: Subject to any disclaimer, the term of this patent is extended or adjusted under 35 U.S.C. 154(b) by 0 days.

(21) Appl. No.: 09/238,489

(22) Filed: Jan. 27, 1999

(51) Int. Cl.[7] ..... A47D 13/06
(52) U.S. Cl. ..... 5/93.1; 5/97; 135/135
(58) Field of Search ..... 5/93.1, 93.2, 97; D6/390, 389; 135/124, 100, 125, 135

(56) References Cited

U.S. PATENT DOCUMENTS 4,750,509 A * 6/1988 Kim ..... 135/135
5,634,483 A * 6/1997 Gwin ..... 135/124 X
5,706,533 A * 1/1998 Opheim et al. ..... 5/93.1 X

OTHER PUBLICATIONS

3 Pages from Little Miss Liberty Round Crib Company (LMLRCC) Catalog, dated 6/96.
Assembly Instructions for Standard/Canopy Top Round Wood Crib, LMLRCC, dated 6/96.
Assembly Instructions for Round Crib Bedding Ensemble, Little Miss Liberty of Beverly Hills, dated 6/96.

* cited by examiner

*Primary Examiner*—Terry Lee Melius
*Assistant Examiner*—James M Hewitt
(74) *Attorney, Agent, or Firm*—Blakely Sokoloff Taylor & Zafman

(57) ABSTRACT

A canopy assembly for a crib. The canopy assembly has a hub, a canopy base, and a number of curved arms which connect to each other to alternatively form a dome canopy and a concave (fluted dome) canopy.

20 Claims, 6 Drawing Sheets

CANOPY ASSEMBLY HAVING UNIVERSAL COMPONENTS FOR DIFFERENT TYPES OF CANOPIES

RELATED APPLICATIONS

The subject matter of this patent application is related to the following U.S. patent applications of Jean Kasem, "METHOD AND APPARATUS FOR CONVERTING A CANOPY CRIB TO A STANDARD CRIB" (U.S. Pat. No. 6,148,455), and "CONVERTIBLE CANOPY CRIB" (U.S. Pat. No. 6,131,217) which are filed on the same date as this application and which are incorporated by reference herein as if set forth in their entirety herein.

BACKGROUND INFORMATION

1. Field of the Invention

This invention is generally related to cribs, and more particularly to canopy cribs having dome-shaped and so-called fluted dome canopies.

2. Description of the Related Art

Canopy cribs for babies have become very popular with parents. There are many different types of canopy cribs distinguished by the type of canopy being used. Canopies may be of a variety of different shapes, two of which have become particularly popular. These are the canopy having a convex structure similar to a dome, and one having a type of inverted dome (or so-called fluted dome) which has a concave outwardly surface. The canopy assembly is typically made of a cloth material that is given a convex or concave appearance by an underlying frame structure. A conventional technique for implementing the dome canopy is described and illustrated in the section of a brochure entitled, "Round Dome Bedding Assembly" for canopy cribs produced by Little Miss Liberty of Beverly Hills of Burbank, Calif. The conventional dome canopy is assembled by connecting a number of curved arms to a central hub on one end and to a circular canopy base on another end. The lower end of each arm is strapped to the canopy base using a hook and loop fastener. Although such a structure adequately performs that task of providing a frame for a dome canopy, it is desirable to obtain a more efficient technique for implementing the dome canopy, namely one that will reduce manufacturing costs. In addition, given the popularity of the concave or fluted dome canopy illustrate in the section of the same brochure entitled, "Fluted Dome Bedding Assembly," it would also be desirable that the components used for implementing the concave canopy be interchangeable with those required for the dome canopy.

SUMMARY

Accordingly, an embodiment of the invention is directed at a canopy assembly whose components can be used for both a dome canopy and a concave canopy. The basic embodiment of the dome canopy assembly includes a hub having a side surface, a bottom surface, and a number of hub openings arranged on the side surface. A canopy base has a number of canopy base openings therein. A number of curved arms are connected between the hub and the canopy base. Each of the curved arms has a convex surface opposite a concave surface. An upper protrusion is formed on an upper end of the arm and a lower protrusion is formed on the lower end of the arm. The upper protrusion of each arm mates with a respective one of the hub openings on the side surface of the hub, while the lower protrusion of each arm mates with a respective one of the canopy base openings, such that the convex surface of each arm faces outwards from the canopy assembly and thus provides the structure needed for a dome canopy. These arms can also be used to form a concave canopy.

In another embodiment of the invention as a concave canopy assembly, a number of hub openings are arranged on the bottom surface of the hub. The openings in the canopy base face into the crib assembly, such that when the lower protrusion of each arm mates with the canopy base opening and the upper protrusion mates with a hub opening in the bottom surface of the hub, with the concave surface of each arm facing outwards, a concave canopy is formed.

These as well as other features and advantages of different embodiments of the invention will be more apparent by referring to the claims, written description, and drawings below.

DETAILED DESCRIPTION

As summarized above, an embodiment of the invention provides for a canopy assembly having components which are relatively low cost to manufacture as well as easy for the average consumer to put together in order to form either a dome canopy or a concave canopy.

Figure 1:
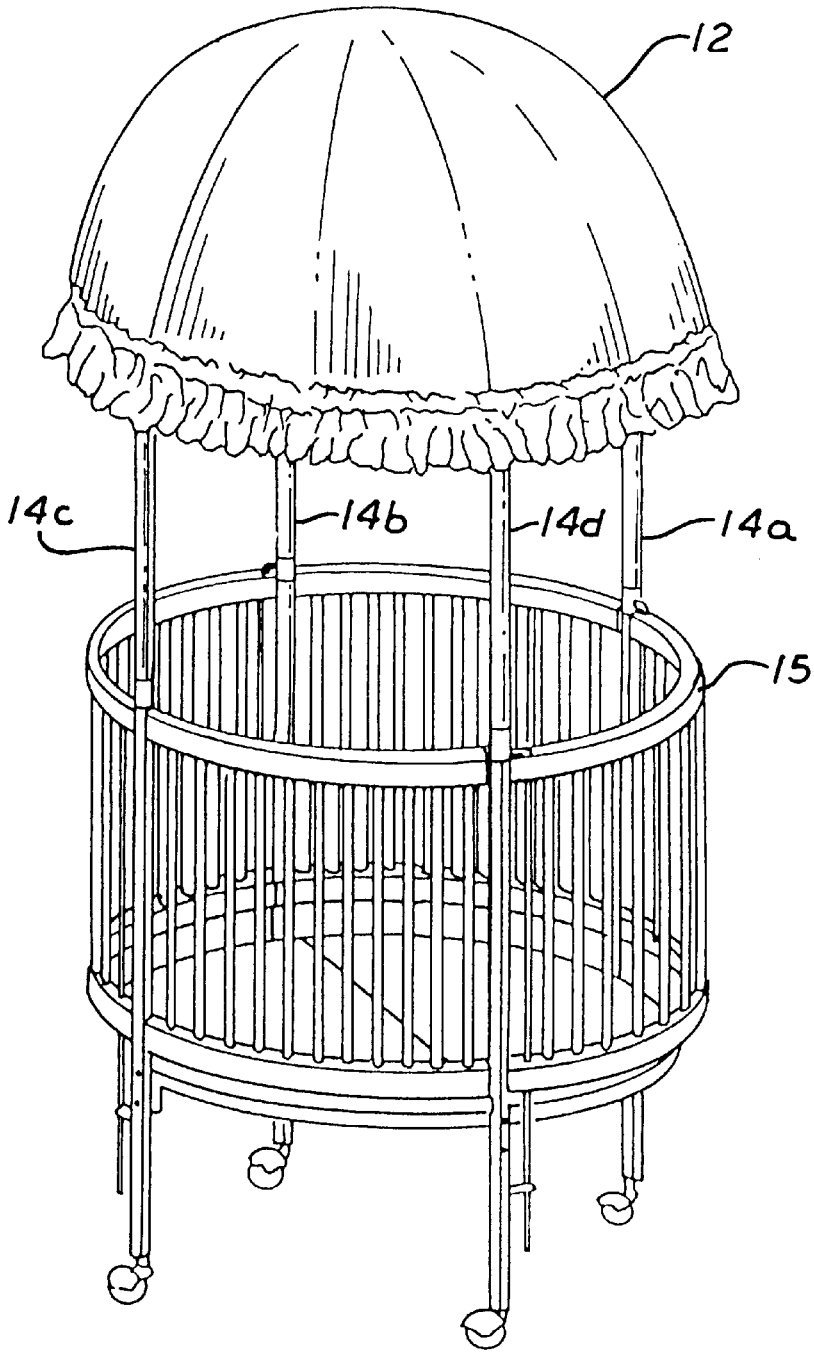
FIG. 1 shows a perspective view of a canopy assembly having a dome shape atop a conventional crib.
Figure 2:
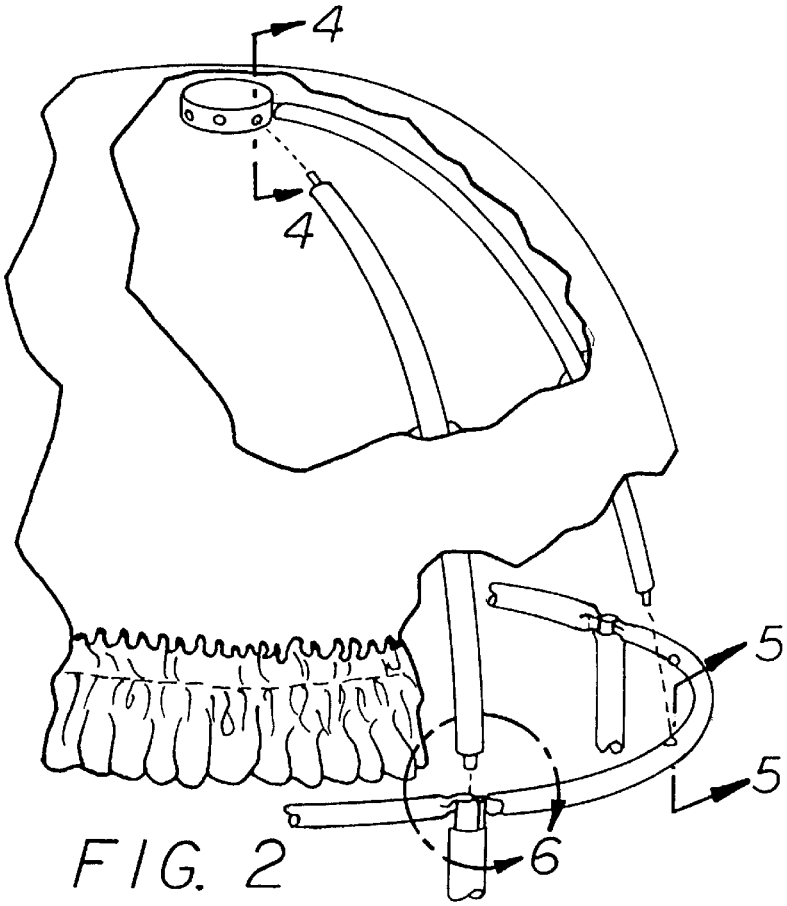
FIG. 2 shows a cutaway view of the frame for supporting the dome shape of the canopy assembly, according to an embodiment of the invention.

Beginning with FIG. 1, a canopy assembly 12 according to an embodiment of the invention is shown as part of a crib having legs 14*a* . . . 14*d*. The legs 14 in addition to supporting the canopy assembly 12 may also support the crib itself. The crib 15 may be of any conventional design, and is not limited to being a round crib as shown, but can alternatively be rectangular. FIG. 2 shows a cutaway view of the structure of the canopy assembly 12 according to an embodiment of the invention. A central hub 20 is located at the top of the crib assembly. The hub 20 has a side surface as shown with a number of hub openings. A number of curved arms 26 are provided, preferably spaced in equal increments, around the hub 20 to support the canopy cloth 22. The upper end of each arm 26 mates with a respective opening in the hub 20, while a lower end of the arm 26 mates with a respective opening in a canopy base 24. The canopy base 24 may then be connected to the canopy legs 14 according to conventional techniques, or according to the embodiment of the invention described in FIG. 6 below.

Figure 3:
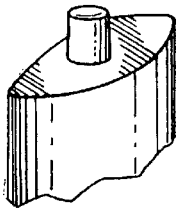
FIG. 3 is a closeup of an end portion of an arm used in the canopy assembly.
Figure 4:
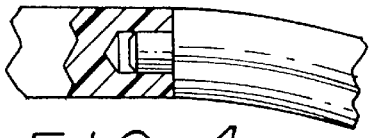
FIG. 4 shows a cross-section of an arm mated with a hole in the side surface of the hub.
Figure 5:
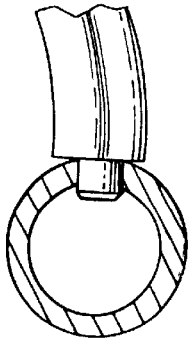
FIG. 5 shows a cross-section of an arm mated with a hole in the canopy base.

FIG. 3 shows a closeup view of an end of an arm 26. A protrusion 32 appears at either end of each arm. FIGS. 4 and 5 illustrate how the protrusion fits into a mating hub opening 28 in the hub 20 and a canopy opening 23 in the canopy base 24. Note that the hub opening 28 is in a side surface of the hub 20 and the opening 23 is located at the top of the canopy base 24. These openings are also arranged, preferably in equal increments, around the enclosed canopy base 24, and aligned with corresponding hub openings 28. Note that in the configuration shown in FIG. 2, the curved arms 26 have their convex surfaces facing outwards, such that a dome canopy is supported.

Figure 6:
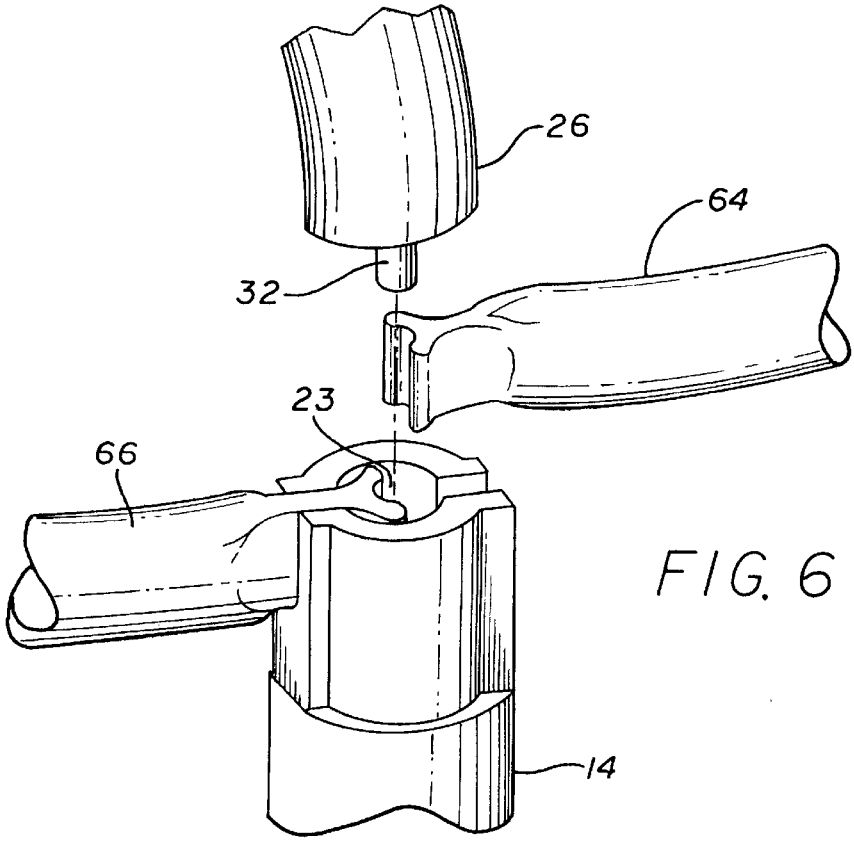
FIG. 6 shows an alternative technique for connecting an arm to the canopy base.
Figure 7:
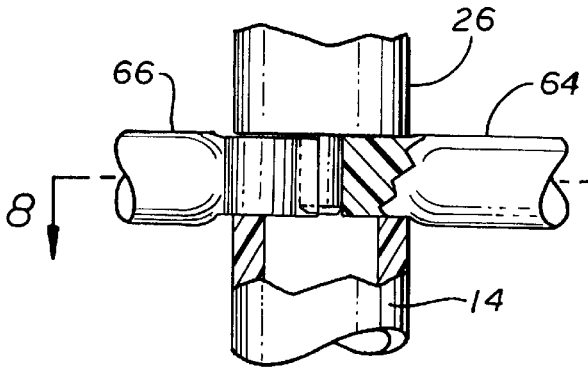
FIG. 7 is a side cross-sectional view of the embodiment of FIG. 6.
Figure 8:
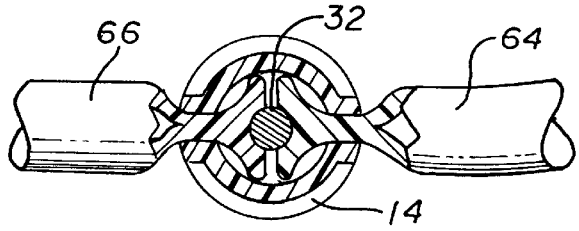
FIG. 8 is a top cross-sectional view of the embodiment of FIG. 6.

FIG. 6 shows an alternative arrangement for connecting an arm 26 to the canopy base, as well as a way to connect the canopy base 24 to the canopy legs 14. In this embodiment, the canopy base 24 is composed of several base segments connected to each other, head to tail. In particular, FIG. 6 shows two adjoining base segments 64 and 66 whose junction defines the opening 23. The junction is formed by the base segments 64 and 66 being held together by the top of the canopy leg 14. Anchoring the arms 26 in this way may provide the dome canopy with greater structural rigidity. FIGS. 7 and 8 show additional views of the embodiment of the invention in FIG. 6, and accordingly are self-explanatory.

Figure 9:
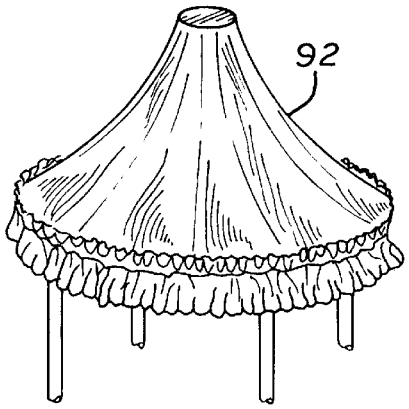
FIG. 9 shows a canopy assembly having a concave or fluted dome shape.
Figure 11:
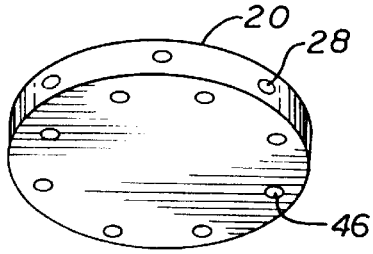
FIG. 11 is a perspective view of a hub which is an interchangeable component of both dome and concave canopy assemblies according an embodiment of the invention.
Figure 12:
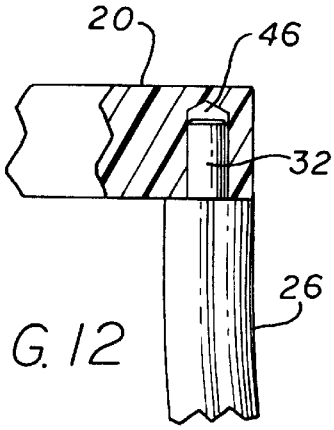
FIG. 12 shows a cross-sectional view of an arm mated with a hole in a bottom surface of the hub.
Figure 10:
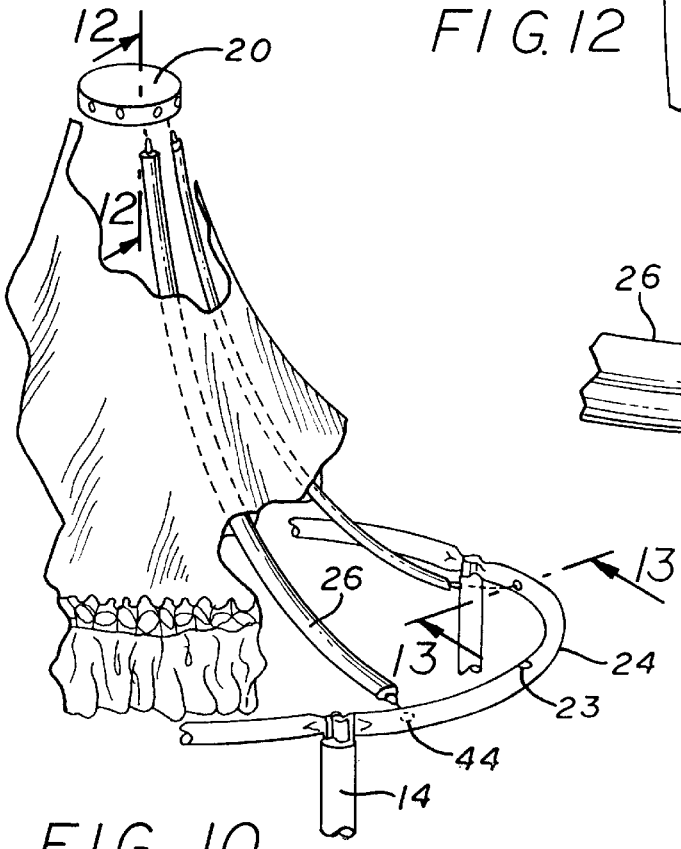
FIG. 10 shows a cutaway view of the structure supporting the concave canopy according to an embodiment of the invention.
Figure 13:
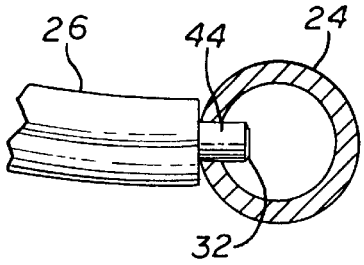
FIG. 13 shows a cross-section of an arm mated with a hole in the canopy base for implementing a concave canopy.

Some of the components of the canopy assembly described above may also be used to form a concave canopy assembly 92 as shown in FIG. 9. FIG. 10 illustrates a cutaway view of the concave canopy assembly 92 according to another embodiment of the invention. The central hub 20 in this case has a number of openings 46 arranged on its bottom surface (not shown in FIG. 10, but see FIG. 11) which mate with the protrusions on the upper ends of arms 26. At the lower end of each arm 26, the protrusion mates with an opening 44 on the canopy base 24. The opening 44 points into the canopy assembly 92. FIG. 12 shows a cross-sectional view of the arm 26 mated with an opening 46 in a bottom surface of the hub 20. Although shown as being essentially vertical, the opening 46, depending upon the length and curvature of the arm 26 and the overall shape desired for the concave canopy assembly 92, may be at an angle. FIG. 13 shows the lower end of the arm 26 being mated with the opening 44 on the side of the canopy base 24. By turning over the arm 26 such that its concave surface now points outwards, a concave canopy or fluted dome structure can be supported. In addition to the arm 26 being interchangeable for both a dome canopy and a concave canopy, the canopy base 24 also becomes interchangeable when provided with two sets of openings, one set of openings 44 and another set of openings 23 as shown in FIG. 10. Similarly, the hub 20 can also be interchangeable if configured with two sets of openings, a first set of openings 28 arranged around the side surface and a second set of openings 46 arranged in the bottom surface, as shown in FIG. 11.

Figure 14:
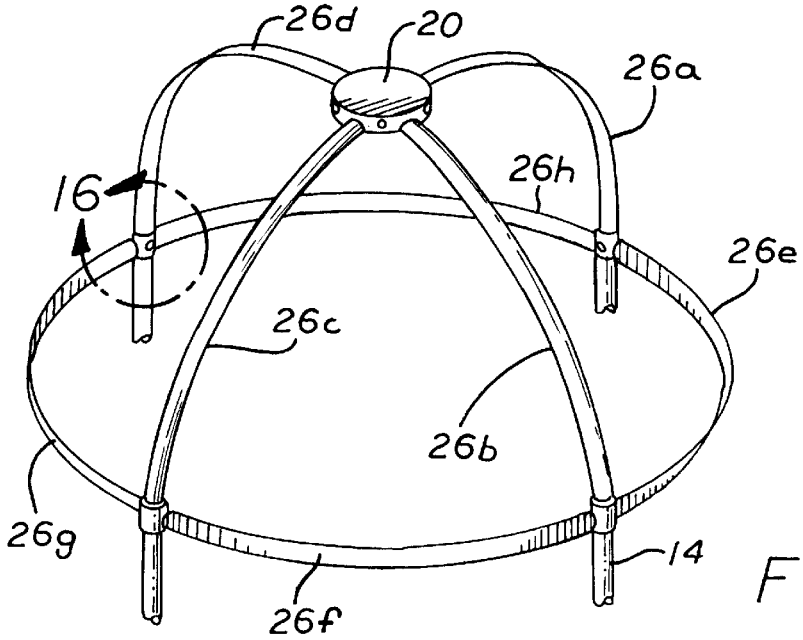
FIG. 14 is a perspective view of the structure used for a dome canopy according to another embodiment of the invention.
Figure 16:
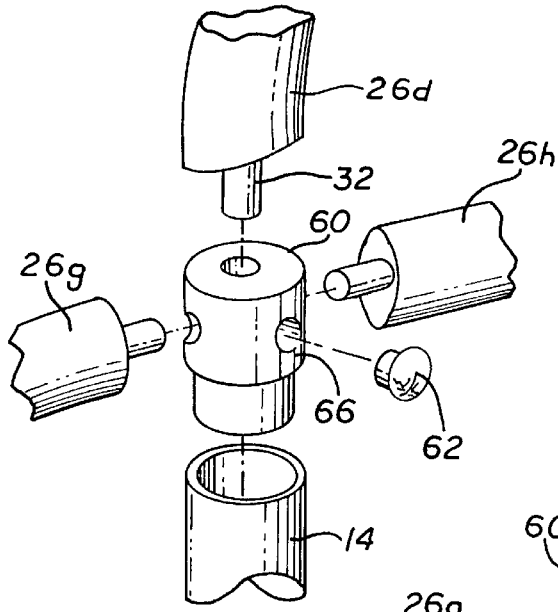
FIG. 16 shows a closeup exploded view of a junction at a canopy leg for implementing a dome canopy.

FIG. 14 shows another embodiment of the canopy assembly 12. In this embodiment, some of the openings 28 in the side surface of hub 20 are aligned with the canopy legs 14. This allows some of the arms 26 to connect directly to the top of a canopy leg 14 for greater structural support. Additional arms (not shown), may be provided in the embodiment of FIG. 14 so that a total of 8 arms are used to form the structure for a dome canopy. FIG. 16 shows an exploded view of the junction at the canopy leg 14 of this embodiment. A junction piece 60 may be provided which is connected to the top of the canopy leg 14, and receives an arm 26*d* at its top. The opposing sides of the junction piece 60 are provided with openings to mate with adjoining base segments 26*g* and 26*h*. In this particular embodiment, the curved arms 26 are not only used as the top portion of the frame that connects with the hub 20, but are also used as base segments 26*e* . . . 26*h* to in effect form the canopy base 24. Thus, further cost reduction can be obtained using the embodiment of FIG. 16 because copies of the arms 26 are used to form the canopy base 24.

Figure 15:
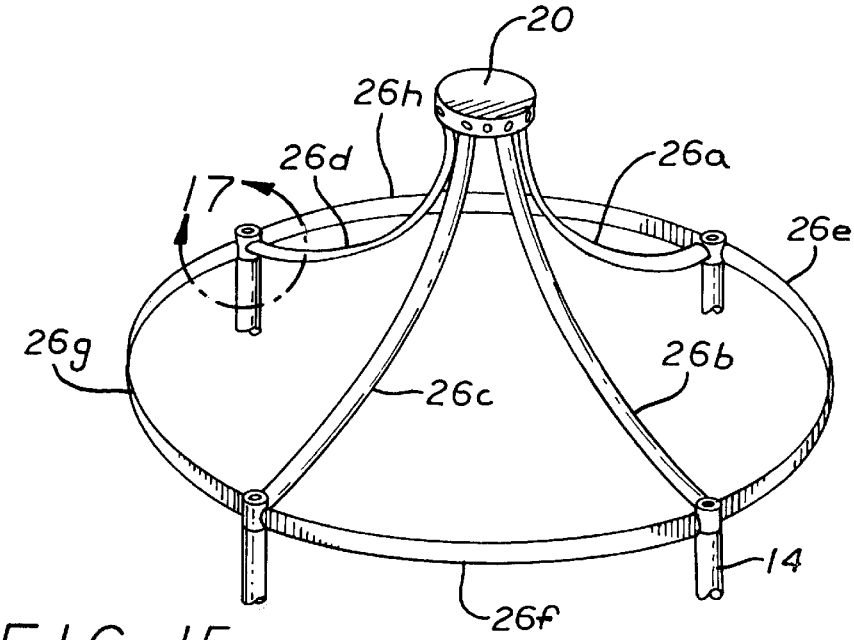
FIG. 15 shows the structure for a concave canopy according to another embodiment of the invention.
Figure 17:
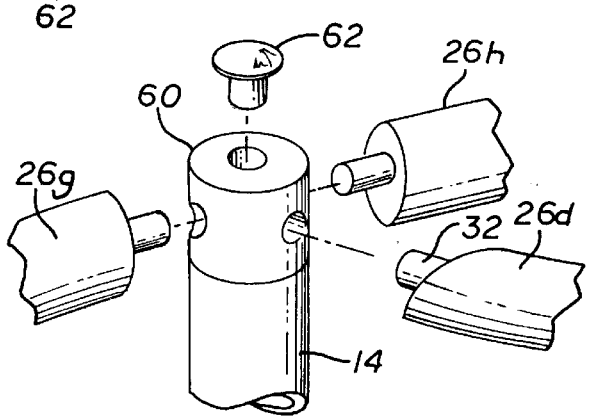
FIG. 17 shows an exploded view of the junction at a canopy leg for implementing a concave canopy.

FIG. 15 illustrates another embodiment of the concave canopy assembly 92. Once again, the arms 26 find dual use: as vertical supports for the hub 20 and as the canopy base 24 itself. A closeup of the junction at the canopy leg 14 of FIG. 15 is illustrated in FIG. 17. Here, it can be seen that the junction piece 60 may also be an interchangeable component between the dome and concave canopy assemblies. When the interchangeable junction piece 60 is used for a dome canopy as in FIG. 16, its opening 66 may be plugged with a cap 62.

Figure 18:
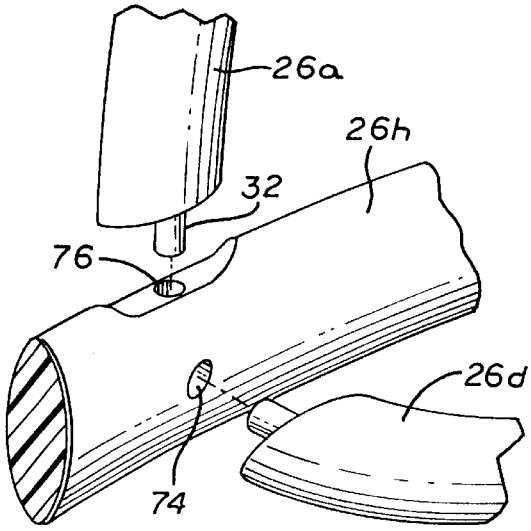
FIG. 18 shows connections between the arm and the canopy base for a dome canopy and for a concave canopy.

In addition to the four arms 26*a* . . . 26*d* shown in FIGS. 14 and 15 as forming the top portion of the canopy assembly, additional arms 26 may be provided, particularly for the dome canopy, if needed for further support. These additional arms may be connected as shown in FIG. 18. FIG. 18 illustrates that the lower protrusion 32 of arm 26*a* connects to an opening 76 on top of and along the edge of arm 26*h* that is used as a base segment of the canopy base for the dome canopy. For the concave canopy, an opening 74 is provided on the side of the base segment to mate with an arm 26*d* which has its concave surface facing outwards. One of ordinary skill in the art will recognize that a combination of the structure in FIGS. 16 and 17 with the structure in FIG. 18 may be used to implement the frame needed for a dome or concave canopy.

The various components of the canopy assemblies described above may be supplied as a kit to the consumer along with a brochure of instructions for combining the components to form either the dome or concave canopy assemblies. A variety of different materials can be used to manufacture the components described above. For lower cost, injection molding and extrusion of plastic material can be used for essentially all of the components described. An alternative to the use of plastic for the protrusion 32 at the end of the arm 26 would be to use a metal dowel for a more reliable connection between the arm and either the hub 20 or the canopy base 24. The canopy assembly may also be made of wood and/or metal, if desired.

One of ordinary skill in the art will recognize that the invention illustrated above is capable of use in other combinations and environments, and is capable of changes and modifications within the scope of the inventive concept as expressed here. For instance, although the canopy base 24 in FIG. 5 is shown as having a substantially circular and hollow cross-section, other types of structures can also be developed which still allow the arms 26 and hub 20 to be interchangeable between the dome and concave canopies. Accordingly, it is intended that all such modifications and/or changes be within the scope of the claims.

What is claimed is:

1. A canopy assembly for a crib, comprising a hub having a side surface, a bottom surface, a plurality of first hub openings arranged on the side surface and a plurality of second hub openings arranged on the bottom surface;

a canopy base having a plurality of first canopy base openings and a plurality of second canopy base openings; and a plurality of curved arms connected between the hub and the canopy base, each of the curved arms having a convex surface, a concave surface opposite said convex surface, an upper end, a lower end, an upper protrusion on the upper end, and a lower protrusion on the lower end, the upper protrusion of each arm can alternatively be mated with one of the first hub openings and one of the second hub openings, and the lower protrusion of each arm can alternatively be mated with one of the first canopy base openings and one of the second canopy base openings.

2. The canopy assembly of claim 1 wherein the side surface of the hub is continuously cylindrical.

3. The canopy assembly of claim 1 wherein the canopy base is a hoop having the second canopy base openings formed therein and facing into the hoop.

4. A kit of parts for a canopy assembly, comprising:

a hub having a side surface, a bottom surface, a plurality of first hub openings arranged on the side surface and a plurality of second hub openings arranged on the bottom surface;

a canopy base having a plurality of first canopy base openings and a plurality of second canopy base openings; and a plurality of curved arms to be connected between the hub and the canopy base, each of the curved arms having a convex surface, a concave surface opposite said convex surface, an upper end, a lower end, an upper protrusion on the upper end, and a lower protrusion on the lower end, the upper protrusion of each arm can alternatively be mated with one of the first hub openings and one of the second hub openings, and the lower protrusion of each arm can alternatively be mated with one of the first canopy base openings and one of the second canopy base openings.

5. The kit of claim 3 wherein the canopy base includes a plurality of base segments to be connected to each other head to tail to form the base.

6. The kit of claim 5 wherein each of the first canopy base openings is formed at a junction of an adjoining pair of said base segments.

7. The kit of claim 4 wherein the side surface of the hub is continuously cylindrical.

8. The kit of claim 4 wherein the canopy base is shaped as a hoop.

9. The kit of claim 4 further comprising:

a crib assembly having a crib base and a crib side; and a plurality of canopy legs that are to be connected to the canopy base at one end and to the crib assembly at another end of the legs to support the canopy assembly above the crib assembly.

10. The kit of claim 9 wherein the crib assembly further comprises a plurality of crib legs that are to be connected to the crib side to support the crib assembly.

11. The kit of claim 10 wherein the crib side comprises a plurality of side segments that are to be arranged around the crib base in head to tail fashion to form the crib side.

12. The kit of claim 11 wherein the crib base and the crib legs are to be attached to the side segments.

13. A crib comprising:

a crib assembly having a crib base and a crib side extending upwards from the base, the crib side having five or more elongated members spaced around the crib base to prevent a child lying on the crib base from removing herself therefrom; and a canopy assembly having a lower canopy base and an upper canopy base, a plurality of canopy legs connected to the lower base at one end and to the crib assembly at another end of the legs to support the canopy assembly above the crib assembly, the lower canopy base having a plurality of first lower canopy base openings and a plurality of second lower canopy base openings, the upper canopy base having a plurality of first upper canopy base openings arranged on the side surface and a plurality of second upper canopy base openings arranged on the bottom surface, and a plurality of curved arms each having an upper protrusion at an upper end and a lower protrusion at a lower end, the upper protrusion of each arm can alternatively be mated with one of the first upper canopy base openings and one of the second upper canopy base openings, and the lower protrusion of each arm can alternatively be mated with one of the first lower canopy base openings and one of the second lower canopy base openings.

14. The crib of claim 13 wherein each of the arms has a convex surface and an opposing concave surface, the canopy assembly having a dome shape when the arms are connected to the upper and lower bases with the convex surface of each arm facing outwards of the canopy assembly, the canopy assembly having an inverted funnel shape with an inwardly curved surface when the arms are connected with the concave surface of each arm facing outwards.

15. The crib of claim 13 wherein the crib assembly further comprises a plurality of crib legs connected to the crib side to support the crib.

16. The crib of claim 13 wherein the canopy assembly further comprises a plurality of lower base segments arranged in head to tail fashion to form the lower canopy base.

17. The crib of claim 16 wherein adjoining pairs of the plurality of lower base segments are joined at respective canopy legs.

18. The crib of claim 17 wherein each of the first lower canopy base openings is formed at a junction of an adjoining pair of the lower base segments.

19. The crib of claim 15 wherein the crib assembly further comprises a plurality of side segments arranged around the crib base in head to tail fashion to form the crib side.

20. The crib of claim 19 wherein the crib base and the crib legs are attached to the side segments.

* * * * *